US007150083B2

(12) United States Patent
Schemken et al.

(10) Patent No.: US 7,150,083 B2
(45) Date of Patent: Dec. 19, 2006

(54) COMPRESSIVE CRIMPING DEVICE FOR A SYNTHETIC MULTI-THREADED YARN

(75) Inventors: Matthias Schemken, Neumünster (DE); Mathias Stündl, Wesel (DE); Diethard Hübner, Bordesholm (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 323 days.

(21) Appl. No.: 10/477,256

(22) PCT Filed: May 3, 2002

(86) PCT No.: PCT/EP02/04859

§ 371 (c)(1),
(2), (4) Date: Jun. 4, 2004

(87) PCT Pub. No.: WO02/090632

PCT Pub. Date: Nov. 14, 2002

(65) Prior Publication Data

US 2004/0200048 A1 Oct. 14, 2004

(30) Foreign Application Priority Data

May 10, 2001 (DE) ..... 101 22 600

(51) Int. Cl.
*D02G 1/12* (2006.01)

(52) U.S. Cl. ..... 28/266; 28/263; 28/255

(58) Field of Classification Search ..... 28/263, 28/266, 264, 265, 267, 269, 271, 253–257, 28/250, 251, 247, 258, 221, 248; 57/264
See application file for complete search history.

(56) References Cited

U.S. PATENT DOCUMENTS

| | | | | |
|---|---|---|---|---|
| 3,798,718 | A | 3/1974 | Trifunovic | |
| 3,816,887 | A * | 6/1974 | Smith et al. | 28/256 |
| 3,908,248 | A * | 9/1975 | Schmid et al. | 28/255 |
| 4,301,578 | A * | 11/1981 | Dammann et al. | 28/266 |
| 4,620,345 | A | 11/1986 | Fleissner | |
| 5,088,168 | A * | 2/1992 | Berger et al. | 28/249 |
| 5,653,010 | A * | 8/1997 | Grossenbacher et al. | 28/256 |
| 5,974,777 | A * | 11/1999 | Davis | 28/266 |

(Continued)

FOREIGN PATENT DOCUMENTS

DE 4224454 A1 2/1993

OTHER PUBLICATIONS

Copy of International Search Report mailed Sep. 20, 2002 with published PCT application WO 02/090632 A1.

*Primary Examiner*—A. Vanatta
(74) *Attorney, Agent, or Firm*—Alston & Bird LLP

(57) ABSTRACT

The invention relates to a compressive crimping device for a synthetic multi-threaded yarn. The thread is compressed by a texturing device to form a tangle of thread. The tangle of thread is subsequently cooled by means of a cooling device and unraveled to form a crimped thread. The tangle of thread runs through a heating area in the transition area between the texturing device and the cooling device, the heating area being essentially defined by the distance between the tangle outlet of the texturing device and a tangle receiving element of the cooling device. According to the invention, a means of adjustment is provided in order to adjust the distance and deflection angle between the tangle outlet and the element receiving the tangle.

11 Claims, 4 Drawing Sheets

U.S. PATENT DOCUMENTS 6,141,843 A * 11/2000 Hegenbarth et al. ..... 28/263
6,305,059 B1 * 10/2001 Mayer ..... 28/263
2004/0016092 A1 * 1/2004 Wirz ..... 28/254
2004/0031134 A1 * 2/2004 Koslowski et al. ..... 28/263

* cited by examiner

COMPRESSIVE CRIMPING DEVICE FOR A SYNTHETIC MULTI-THREADED YARN

BACKGROUND OF THE INVENTION

The present invention relates to a device for compressive crimping of a synthetic multifilament thread.

A device of this type is disclosed in DE 42 24 454 A1. This known device has a texturizing device for creating a thread stuffing. In this process, a multifilament thread is conveyed in the texturizing unit by means of a fluid stream and compressed to a thread stuffing inside a compressing chamber. In this process, the filaments of the thread are laid down in the form of loops and bends. The thread is heated to obtain a greater impression of the loops and bends within the filaments. At a fixed distance below the texturizing unit, a cooling unit is provided through which the thread stuffing is cooled. In this way the loops and bends of the filaments are fixed within the thread stuffing which leads to crimp strength. The transition of the thread stuffing from the texturizing unit to the cooling unit thus represents a phase in which the heat contained in the thread stuffing acts on the polymer of the thread. The transition from texturizing unit to cooling unit thus forms a warming path, in which heat is neither supplied from nor withdrawn to the outside. In the known device, the length of the warming path is fixed.

It is now an object of the present invention to further develop the known device described above in such a way that a flexible heat treatment of the thread stuffing within the heating path is possible.

BRIEF SUMMARY OF THE PRESENT INVENTION

The invention is characterized in that the length of the warming path that is formed between a stuffing outlet of the texturizing unit and a stuffing holder of the cooling unit can be changed. In this way, depending on the polymer of the thread, and according to the crimped yarn to be produced, in each case optimum lengths of the warming path can be set. To do this, adjusting means are provided, by which the distance between the stuffing outlet of the texturizing unit and the stuffing holder of the cooling unit is adjustable. In this way, a very short warming path or a long warming path can be set for thermal treatment of the thread stuffing, independently of the speed of the thread stuffing.

The adjusting means for changing the distance between the texturizing unit and the cooling unit can cooperate with a height-adjustable texturizing unit or with a height-adjustable cooling unit. In a case where the texturizing unit is designed so that it is height-adjustable, the position of the stuffing outlet of the texturizing unit will be changed relative to the stuffing holder of the cooling unit by the adjusting means.

With a height-adjustable cooling unit, the adjusting means operates such that the position of the stuffing holder of the cooling unit can change relative to the position of the stuffing outlet of the texturizing unit. In this process, electrical, electromechanical, or electrohydraulic devices are suitable as adjusting means, although the present invention is not limited to such devices for operating the adjusting means.

In an especially preferred embodiment, the cooling unit is formed by a cooling drum that has at least one stuffing groove forming the stuffing holder, which is arranged all around the circumference of the cooling drum. The cooling drum is driven at a speed of rotation that may be adapted to the speed of the thread stuffing in order to ensure uniform stuffing formation within the texturizing unit. However, it is also possible to change the speed of rotation of the cooling unit to influence the stuffing formation within the texturizing unit.

In order to make secure guiding of the thread stuffing from the texturizing device possible, the stuffing outlet is preferably formed by an ejection tube. In this process, preferably a minimum distance is maintained between the end of the ejection tube and the stuffing groove of the cooling drum so that transition of the thread stuffing from the texturizing unit to the cooling unit is possible without interference.

The ejection tube of the texturizing unit is preferably aligned perpendicular to the stuffing groove of the cooling drum. This causes a strong deflection of the thread stuffing that makes possible a breaking open, and thus better cooling, of the stuffing on the cooling drum. However, it is possible for the ejection tube to be aligned so that is essentially tangential to the stuffing groove. In this process, no significant deflection of the thread stuffing takes place.

Another advantage of the present invention is that not only the distance between the stuffing outlet and the stuffing holder can be adjusted, but also simultaneously the degree of deflection of the thread stuffing. For this purpose, the relative arrival position of the thread stuffing is changed on the circumference of the cooling drum by the interaction of the adjusting means with a texturizing unit that can be moved relative to the cooling drum or with a cooling drum that can be moved relative to a texturizing unit. In this way, a short distance between the stuffing outlet and the stuffing holder is associated with a large deflection of the thread stuffing, and on the other hand a large distance is associated with a small deflection.

The arrival position of the thread stuffing is advantageously determined by the degree of deflection so that by selection of a deflection angle, the arrival position of the thread stuffing can be determined at the same time. In this process, the deflection angle can be adjusted in a range between 0° and 90°.

Since the degree of deflection of the thread stuffing essentially influences the subsequent cooling, in that the composition of the thread stuffing is more or less loosened, a combination of a height-adjustable texturizing unit and a movable cooling drum, or vice versa, represents an especially preferred further development of the invention. In this way a small deflection of the thread stuffing with a short distance can be combined with a short warming path. A very slow-acting cooling of the thread stuffing is achieved. In the same way, a long warming path can be combined with a strong deflection of the thread stuffing.

For texturizing the thread, the texturizing unit preferably has a nozzle-shaped conveying duct and a compressing chamber, whereby the thread is guided inside the conveying duct of the texturizing nozzle by a conveyor fluid and opens into the compressing chamber. However, it is also possible to use texturizing units in which the thread is conducted with conveyor rollers and guided into a compressing chamber.

With the use of closed texturizing nozzles with an adjacent compressing chamber it is beneficial that at the beginning of the process, first the stuffing outlet is briefly closed in order to obtain a thread stuffing increase. In this phase it is advantageous if the height-adjustable cooling unit can be moved into an initial position. In this way, the texturizing unit is freely accessible for laying down a thread and for the start of the process. After the thread stuffing has been formed and conveyed, the cooling unit is moved back into an operating position, in which a warming path predetermined for the respective process is adjusted.

The device according to the invention is especially suitable for crimping freshly-spun synthetic multifilament threads of polyamide, polyester, or polypropylene. The individually adjustable heating path makes possible, for every type of polymer and every type of yarn that can be manufactured, an optimum texturizing with very high crimp strength. However, it is also possible to crimp thread drawn from a supply spool by means of the device according to the invention.

BRIEF DESCRIPTION OF THE DRAWINGS

In the following, the invention will be described in more detail using a few embodiment examples according to the attached figures.

The following are shown.

DETAILED DESCRIPTION

Figure 1:
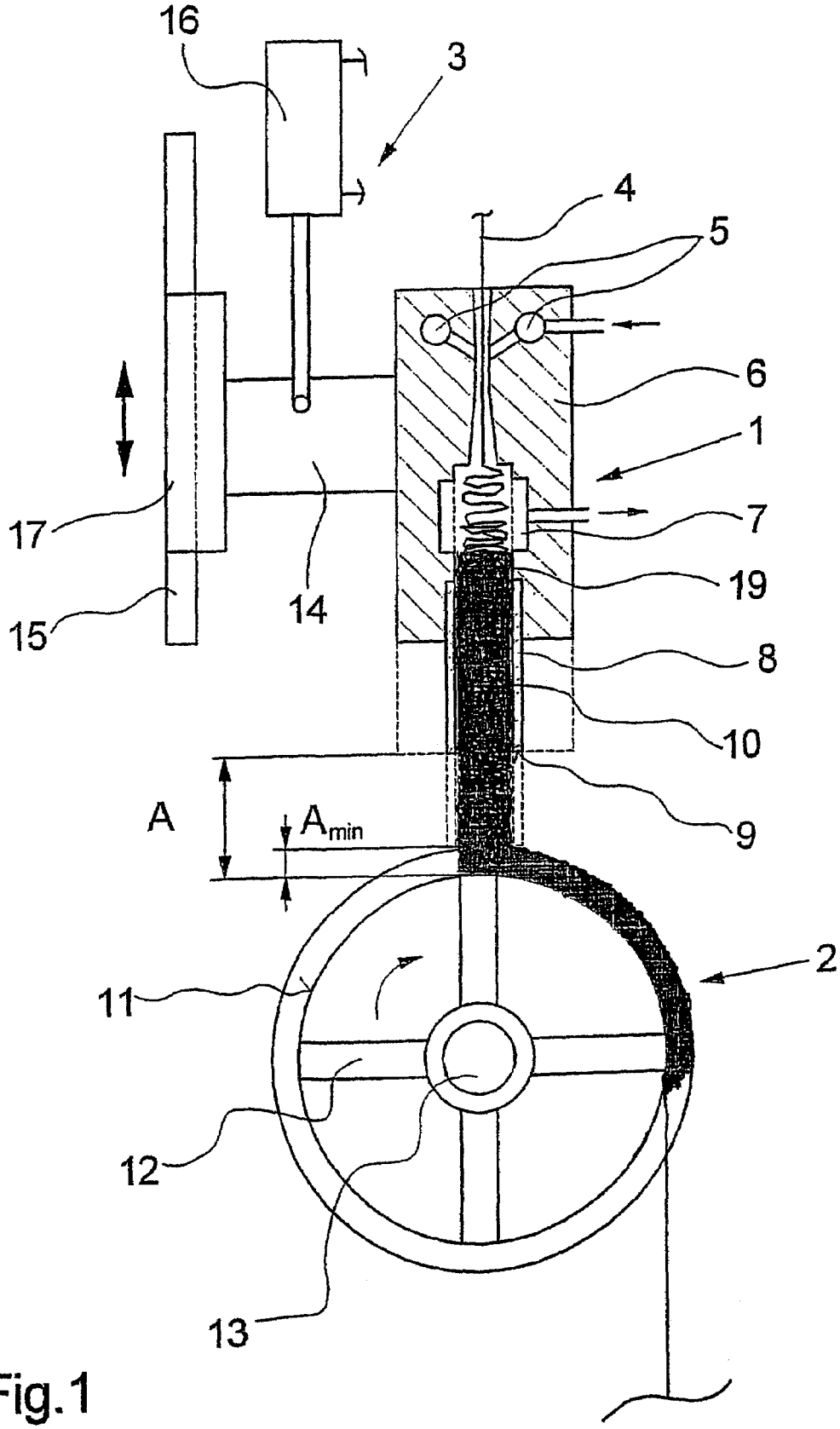
FIG. 1 is a schematic view of a first embodiment of the device according to the present invention.

FIG. 1 shows a first embodiment of the device according to the invention for compressive crimping of synthetic multifilament thread. The device consists of a texturizing unit 1 and a cooling unit 2 downstream of the texturizing unit. Texturizing unit 1 has a nozzle-shaped conveying duct 6. Conveying duct 6 essentially consists of two sections that are separated from each other by a very narrow cross section. In a first section, shortly before the narrow cross section, the nozzle holes of an injector 5 open out into conveying duct 6. Injector 5 is connected to a fluid source that is not shown here. In the second section below the very narrow cross section, the conveying duct 6 expands and opens into a compressing chamber 19 that follows immediately.

In the inlet area of the compressing chamber 19, the compressing chamber wall is designed so that it is permeable to air and arranged within a stress-relieve chamber 7. Below the stress-relief chamber 7, the compressing chamber 19 is continued by an ejection tube 8 with an essentially unchanged cross section. At the end of the ejection tube 8, a stuffing outlet 9 is formed.

The texturizing unit 1 is designed so that it is height-adjustable and connected to adjusting means 3. To do this, texturizing unit 1 is connected by way of a carrier 14 to a movable slider 17, said slider 17 is guided in a guide 15. For positioning the texturizing unit 1 and/or the slider 17, a control cylinder 16 engages carrier 14. Control cylinder 16 can be controlled by control means not shown here in such a way that any desired position of texturizing unit 1 essentially can be set in a vertical direction. In this way, distance A between the stuffing outlet 9 of texturizing unit 1 and a stuffing holder 11 of cooling unit 2 can be adjusted. After leaving the compressing chamber 19, distance A forms a heating path, in which the thread stuffing 10 essentially has no additional heat supplied to it or removed from it.

Cooling unit 2 is designed as a cooling drum 12 that can rotate. Cooling drum 12 is driven by a shaft 13 with a speed of rotation such that it is essentially the same as the production speed of the thread stuffing 10. For holding the stuffing, cooling drum 12 has a stuffing groove 11 that runs around the circumference. The circumference of the cooling drum 12 is designed so that is penetrable by air, so that a cooling air stream that is generated from inside to outside or from outside to inside penetrates the thread stuffing 10 guided in stuffing groove 11 and cools it. After the thread stuffing 10 is cooled, the thread stuffing is pulled out as a crimped thread.

In the embodiment example shown in FIG. 1, the texturizing unit 1 is held in a position by adjusting means 3, in which distance A is set between the stuffing outlet 9 and the stuffing holder 11. The position remains unchanged during texturizing. In texturizing unit 1, a conveyor fluid is fed into the conveying duct 6 by way of injector 5. Because of this, a suction effect develops at the top end of the conveying duct 6, which pulls the thread 4 into texturizing unit 1. Thread 4 is guided by the conveyor fluid through the conveying duct 6 into the compressing chamber 19. In compressing chamber 19, thread 4 compresses to a thread stuffing 10. The filament bundle of thread 4 opens up in this process and the individual filaments of thread 4 contact each other in loops and bends. Formation of the thread stuffing 10 is determined here essentially by the quality of the conveyor fluid and the pressure of the conveyor fluid. Preferably, hot air is used as a conveyor fluid. To reduce the fluid pressure of the conveyor fluid, the upper area of the compressing chamber 19 is designed so that it is permeable to air in the form of air slots or baffles so that the conveyor fluid can escape into a stress-relief chamber 7 and from there downward. The thread stuffing 10 is guided at a set defined speed through stuffing chamber 19 to the stuffing outlet 9. After passing through the heating path, the thread stuffing 10 is taken over by the stuffing groove 11 of cooling drum 12. On the circumference of the cooling drum 12, the thread stuffing is cooled by a cooling air stream. In this process, the cooling drum 12 rotates, preferably at a speed of rotation that is equal to the speed of thread stuffing 10. After cooling, the thread stuffing 10 is drawn from the circumference of cooling drum 12 as a crimped yarn.

In order to cool the thread stuffing 10 immediately after it leaves texturizing unit 1, a position is shown in FIG. 1 in dotted lines in which there is a minimum distance between stuffing outlet 9 and stuffing holder 11. Distance $A_{min}$ thus forms a minimum warming path in order to obtain a short transition time between texturizing in texturizing unit 1 and the crimp setting on cooling drum 12.

An advantage of this is that a strong deflection of the thread stuffing 10 is caused from the transition of texturizing unit 1 to cooling unit 2. This causes the thread stuffing 10 to break open which leads to an intensive cooling of thread stuffing 10 on cooling drum 12.

In addition, in this way the resistance in the continuation of the thread stuffing 10 in the compressing chamber 19 of texturizing unit 1 can be influenced. So for example, a higher resistance during run-out of thread stuffing 10 leads to a more compact thread stuffing with greater density of the filaments placed within thread stuffing 10.

Figure 2:
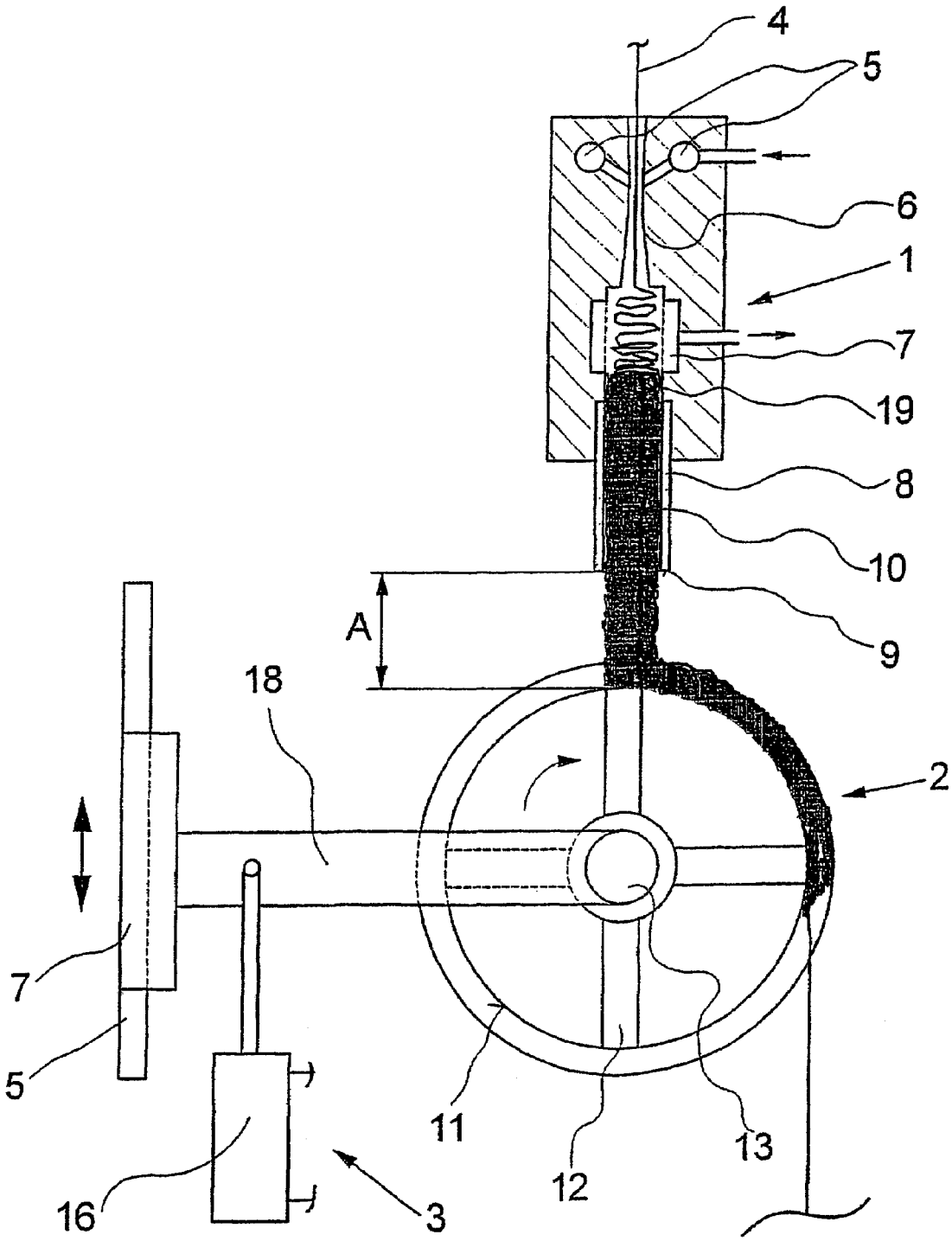
FIG. 2 is a schematic view of an additional embodiment of the device according to the present invention.

FIG. 2 shows a diagram of another embodiment the device according to the invention. Texturizing unit 1 and cooling unit 2 are designed identically to the embodiment in FIG. 1. Reference is made to the description of FIG. 1 in this regard, and at this point only the differences will be described.

In the device shown in FIG. 2, cooling unit 2 is designed so that it is height-adjustable and works together with the adjusting means 3. Adjusting means 3 has a controllable control cylinder 16 and a control means for controlling control cylinder 16, not shown in further detail. Control cylinder 16 is connected to a carrier 18, at one end of which cooling drum 12 is held. On the opposite end, carrier 18 is coupled with a height-adjustable slider 17 that is guided in guide 15.

To adjust the warming path that is formed by the distance A between the stuffing outlet 9 of the texturizing unit 1 and the stuffing holder 11 of the cooling unit 2, the position of cooling drum 12 is adjusted by adjusting means 3. By activation of the control cylinder 16, the cooling drum 12 can be moved up or down on slider 17. When the desired length of the warming path is reached, the position of cooling drum 12 is maintained. Secure operation of cooling drum 12 is ensured by fastening means not shown here.

FIG. 3 shows another embodiment example of the device according to the invention schematically. Texturizing unit 1 and cooling unit 2 are designed identically to the embodiment in FIG. 1. Reference is made to the description of FIG. 1 in this regard.

Figure 3A:
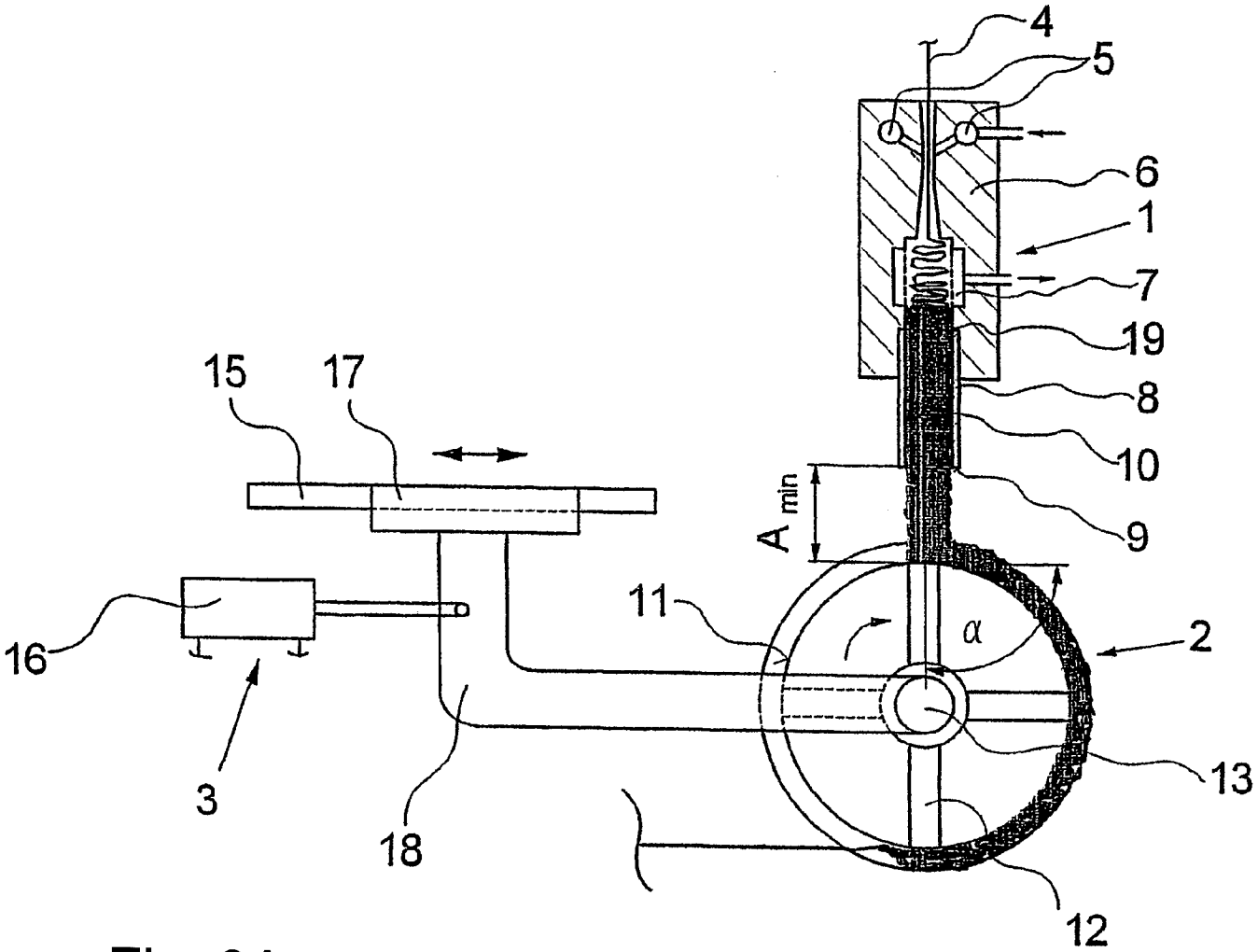
FIGS. 3A and 3B are schematic views of further embodiments of the device according to the present invention.

The embodiment example is shown in two different operating positions. In this case, FIG. 3A shows the embodiment in an operating position with minimum heating path and FIG. 3B with a maximum heating path between the texturizing unit 1 and cooling unit 2. To the extent that no explicit reference is made to one of the figures, the following description applies to both figures.

Figure 3B:
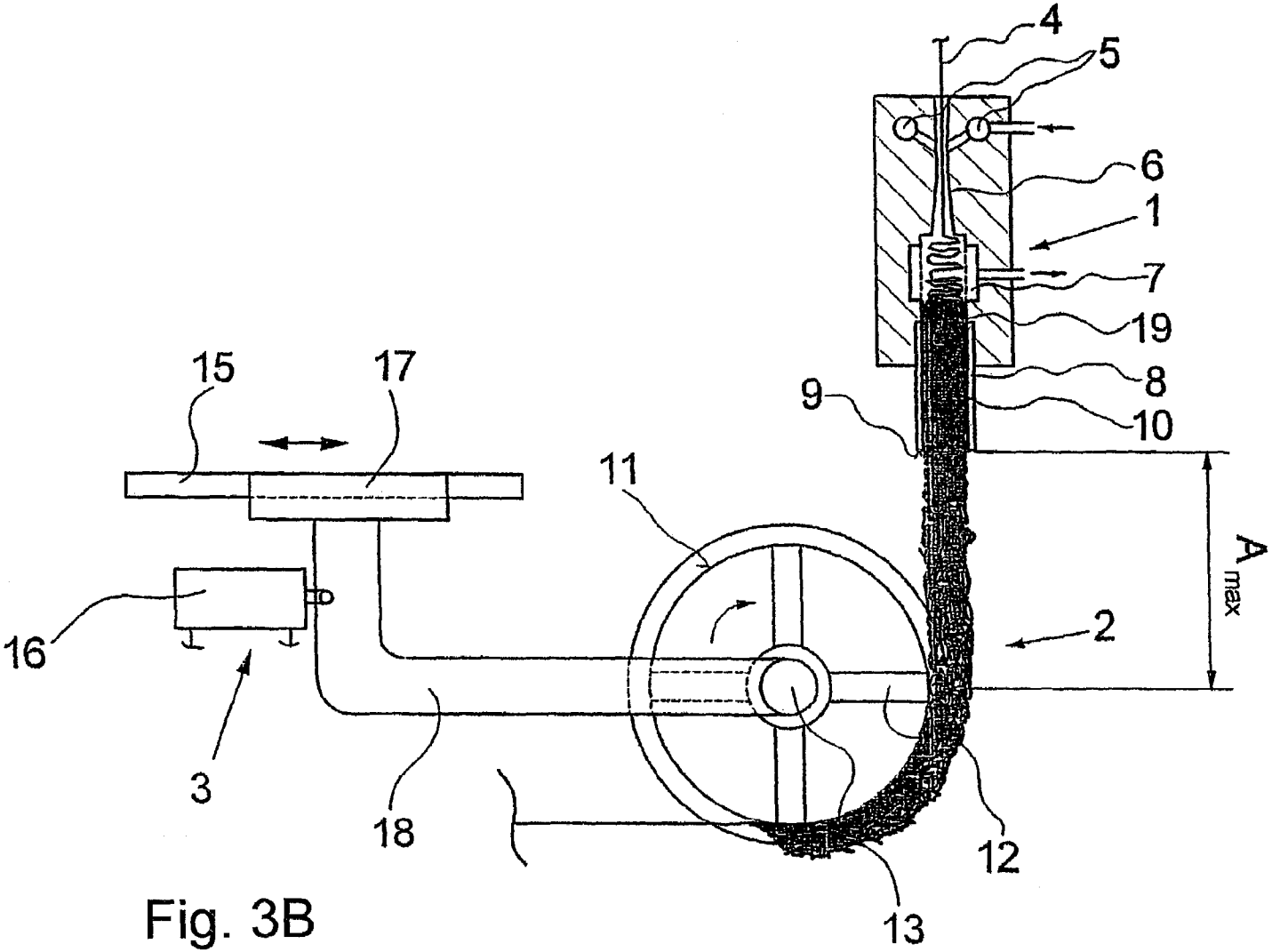

In the device shown in FIGS. 3A and 3B, the cooling unit 2 is designed so that it can be slid and works together with the adjusting means 3. The adjusting means 3 exhibits a controllable control cylinder 16 and a control means not shown for controlling the control cylinder 16. The control cylinder 16 is connected to a carrier 18. Carrier 18 is designed so that it is L-shaped, on one end of which cooling drum 12 is held. On the opposite end, carrier 18 is coupled with a movable slider 17. Slider 17 is guided in a horizontal guide 15.

Texturizing unit 1 is mounted on the thread path in a fixed position above the cooling unit 2.

To adjust the warming path that is formed by distance A between stuffing outlet 9 of texturizing unit 1 and stuffing holder 11 of cooling unit 2, cooling drum 12 is adjusted in its position, perpendicular to the thread running direction by adjusting means 3. By activation of control cylinder 16, cooling drum 12 can be moved to the left or right on slider 17 in the arrangement shown. When the desired length of the warming path is reached, the position of cooling drum 12 is maintained.

FIG. 3A shows an embodiment example in an operating position in which the warming path has a minimum length. In this process, the minimum distance $A_{min}$ is adjusted between stuffing outlet 9 of texturizing unit 1 and the stuffing holder 11 of cooling unit 2. In this position, thread stuffing 10 is deflected upon arrival in the stuffing holder 11. In the arrival position of the thread stuffing, thread stuffing 10 is deflected approximately at a right angle. The deflection can thus characterize a deflection angle $\alpha$ shown in FIG. 3A. The minimum distance $A_{min}$ is thus linked with a deflection angle $\alpha=90°$. Because of the strong deflection of thread stuffing 10, during arrival in the stuffing holder 11, the strong deflection causes a breaking open of thread stuffing 10, which leads to a more intensive cooling on the circumference of cooling drum 12.

FIG. 3B shows an embodiment example in an operating position with maximum warming path. In this case, the thread stuffing 10 essentially impacts the stuffing holder 11 of cooling drum 2 tangentially. Thread stuffing 10 is thus not deflected at the arrival position on the circumference of cooling drum 12. Thus, the deflection angle has a value of 0. In this way, a maximum warming path between texturizing unit 1 and cooling unit 2 is reached, which is characterized by the distance $A_{max}$.

By sliding cooling unit 12, any desired position can be implemented in the area between the positions shown in FIGS. 3A and 3B. In this way, each arrival position of the thread stuffing in the stuffing holder 11 on the circumference of cooling drum 12 can be assigned a specific deflection angle in the range between 0 and 90°.

The embodiment of the device according to the invention shown in FIGS. 3A and 3B can also advantageously be combined with a height-adjustable texturizing unit 1, as shown for example in FIG. 1. In this way, it would be possible to implement short warming paths in which very little or no deflection of the thread stuffing occurs upon arrival in the stuffing holder 11.

Also, the embodiments of the device according to the invention shown in FIGS. 3A and 3B could be further developed in that texturizing unit 1 can be designed so that it slides with respect to a cooling unit 2 in a fixed location. Independently of this, whether texturizing unit 1 or cooling unit 2 can be slid, the advantage additionally results that a placement of the thread can be carried out without problems even with a very short warming path.

The devices shown in the Figures are, for example, designed as a texturizing unit with fluid conveyance of the thread and a cooling unit with rotating cooling drum. The invention, however, is not limited to these designs. The present invention also includes those types of devices, in which, for example, conveyance in the texturizing unit is carried out using mechanical means. In the same way, cooling units that are designed as a cooling tube or a traveling screen running horizontally are also within the scope of the present invention. What is important is the warming path of the thread stuffing in the transition area between texturizing unit and cooling unit. Because of the invention, the warming path can be designed flexibly so that optimum settings are possible, depending on the thread that the polymer is based on and/or depending on the crimping selected.

The design of the adjusting means used in the present invention may also be varied and still be within the spirit and scope of the present invention. Electrical or electronic devices are also suitable as adjusting means. In this process, the texturizing unit and/or cooling unit can be designed so that they are movable. The height adjustment can also be carried out by a texturizing unit that swivels or a cooling unit that swivels.

REFERENCE CHARACTER LIST

1 Texturizing unit
2 Cooling unit
3 Adjusting means
4 Thread
5 Injector
6 Conveying duct
7 Stress-relief chamber
8 Ejection tube
9 Stuffing outlet
10 Thread stuffing
11 Stuffing holder, stuffing groove
12 Cooling drum
13 Shaft
14 Carrier
15 Guide

16 Control cylinder
17 Slider
18 Carrier
19 Compressing chamber

The invention claimed is:

1. A device for compressive crimping of a synthetic multifilament thread comprising:

a texturizing unit for creating a thread stuffing, the texturizing unit comprising a stuffing outlet;

a cooling unit for cooling the thread stuffing, the cooling unit comprising a stuffing holder;

an adjuster for adjusting a distance between the stuffing outlet of the texturizing unit and the stuffing holder of the cooling unit.

2. Device according to claim 1, wherein the texturizing unit is height-adjustable and the position of the stuffing outlet of the texturizing unit can be changed by the adjustor.

3. Device according to claim 1, wherein the cooling unit is height-adjustable and the position of the stuffing holder of the cooling unit can be changed by the adjustor.

4. Device according to claim 1, wherein the cooling unit comprises a cooling drum that has at least one stuffing groove forming the stuffing holder, which is mounted so that the stuffing groove surrounds the circumference of the cooling drum.

5. Device according to claim 4, wherein the stuffing outlet of the texturizing unit comprises an ejection tube and the distance between the end of ejection tube and the stuffing groove of the cooling drum has a minimum size.

6. Device according to claim 5, wherein the ejection tube of the texturizing unit is aligned essentially perpendicularly or tangentially to the stuffing groove of cooling drum.

7. Device according to claim 1, wherein the cooling unit comprises a cooling drum with the stuffing holder formed on the circumference of the cooling drum wherein the cooling unit slides and works together with the adjustor in such a way that an arrival position of the thread stuffing in the stuffing holder can be changed.

8. Device according to claim 7, wherein the arrival position of the thread stuffing can be determined by the degree of deflection (deflection angle) of the thread stuffing, whereby a deflection angle in the range between 0° and 90° can be set by the adjustor.

9. Device according to claim 1, wherein the texturizing unit and/or the cooling unit are height-adjustable and/or horizontally adjustable.

10. Device according to claim 1, wherein the texturizing unit has a nozzle-shaped conveying duct and a compressing chamber, whereby the conveying duct is connected to an injector and opens into the compressing chamber and whereby the compressing chamber is partially formed of an ejection tube.

11. Device according claim 1, wherein the cooling unit can be moved into a placement position, in which the texturizing unit is freely accessible for laying down a thread.

* * * * *